US007394037B2

(12) United States Patent
Lewison

(10) Patent No.: US 7,394,037 B2
(45) Date of Patent: Jul. 1, 2008

(54) ROTARY ELECTRICAL SWITCHING DEVICE

(75) Inventor: John Lewison, Northants (GB)

(73) Assignee: In2tec Ltd., Northamptonshire (GB)

( * ) Notice: Subject to any disclaimer, the term of this patent is extended or adjusted under 35 U.S.C. 154(b) by 118 days.

(21) Appl. No.: 11/379,704

(22) Filed: Apr. 21, 2006

(65) Prior Publication Data

US 2006/0237296 A1 Oct. 26, 2006

(30) Foreign Application Priority Data

Apr. 21, 2005 (GB) ..... 0508077.5

(51) Int. Cl.
*H01H 3/08* (2006.01)

(52) U.S. Cl. ..... 200/336; 200/5 R

(58) Field of Classification Search ..... 200/1 B, 200/1 R–11 TW, 512–517, 18, 336, 1 A
See application file for complete search history.

(56) References Cited

U.S. PATENT DOCUMENTS 5,463,692 A 10/1995 Fackler
6,031,190 A 2/2000 Tokuda et al.
6,281,453 B1 8/2001 Uleski
6,797,903 B1 * 9/2004 Winslett et al. ..... 200/331
6,797,907 B1 * 9/2004 Meagher et al. ..... 200/564

FOREIGN PATENT DOCUMENTS

JP 0836944 * 2/1996

* cited by examiner

*Primary Examiner*—Michael A. Friedhofer
*Assistant Examiner*—Lisa N Klaus
(74) *Attorney, Agent, or Firm*—Joseph S. Heino; Patrick M. Bergin

(57) ABSTRACT

A rotary electric switch 1 comprises a base 2 having a rotary actuator 3 mounted thereon, the base 2 including a pair of substantially parallel, spaced apart substrate layers 6, 7. Each layer 6, 7 has a first surface 9, 10 which faces the other substrate layer 7, 6 and a second surface 11, 12 which faces away from the other substrate layer 7, 6, the first surface 9, 10 of each layer having an electrically conducting contact 13, 14, 16 provided thereon. At least one of the substrate layers 6, 7 is deformable towards the other so as to effect an electrical connection between the contacts 13, 14, 16 on the two layers 6, 7, and the rotary actuator 3 includes a projection 21 which engages against the second surface 11 of said deformable substrate layer 6 so as to press it towards the other layer 7 in the immediate vicinity of the projection 21. In this way, rotation of the rotary actuator 3 moves the projection 21 relative to the substrates 6, 7 and hence varies the point of electrical connection between the contacts 13, 14, 16.

14 Claims, 2 Drawing Sheets

ROTARY ELECTRICAL SWITCHING DEVICE

BACKGROUND OF THE INVENTION

The present invention relates to a rotary electrical switch, preferably for use in a rotary encoder.

Electrical switches are well known, but typically suffer from the disadvantage that they are not adequately sealed from the outside environment and, in particular, do not provide satisfactory protection against the ingress of water. For example, known rotary switches generally comprise an actuator that is required to come into direct contact with electrical contacts in order affect switching states, but said requirement for direct contact makes it difficult to satisfactorily seal the circuitry of the switch from the environment. Furthermore, known electrical switches comprise a domed-shaped conductive contact mounted onto a circuit layer, which, when depressed, makes contact with a further conductive contact mounted within it, on the same circuit layer. Such switches are typically overlaid by a sheet or membrane of some kind such that the actuator does not come into direct contact with the conductive dome. However, these overlays are generally not sealing.

SUMMARY OF THE INVENTION

It is an object of the present invention to provide a rotary electrical switch having a plurality of switch couplings that are in a sealable environment and can be brought into contact with each other via a rotating actuator that is external to the sealable environment.

According to the present invention there is provided a rotary electric switch comprising a base having a rotary actuator mounted thereon, wherein the base includes a pair of substantially parallel, spaced apart substrate layers, each said layer having a first surface which faces the other substrate layer and a second surface which faces away from the other substrate layer, the first surface of each layer having an electrically conducting contact provided thereon, at least one of said substrate layers being deformable towards said other substrate layer so as to effect an electrical connection between said contacts on the two layers, and wherein the rotary actuator includes a projection which engages against the second surface of said deformable layer so as to press the deformable layer towards the other layer in the immediate vicinity of the projection, whereby rotation of the rotary actuator moves the projection relative to the substrates and hence varies the point of electrical connection between the contacts.

A rotary electric switch in accordance with the invention has the advantage that the conducting tracks of the switch are housed in a sealable environment such that the actuator is isolated from any electric contact. This not only makes the switch suitable for use in hazardous environments, such as water-based environments, but also means there is no sliding contact between the actuator and the conducting contacts, which effectively reduces wear on the conducting contacts and increases their lifespan.

Preferably, the first surface of one of said substrate layers is provided with a pair of concentric, radially spaced, generally arcuate tracks, which are centred on the axis of rotation of the rotary actuator. The contact on the other layer may then either effect a contact between each track in order to switch two separate circuits, or, alternatively, may effect a short between the two tracks in order to switch a single circuit.

In a further development, each of said pair of tracks comprises a substantially arcuate portion having a plurality of radial tabs extending therefrom, the tabs on each track extending towards but terminating short of the tabs on the other track. The projection is then positioned so as to press the deformable substrate towards the other substrate in the region between the arcuate portions, the electrical connections then being effected with the tabs.

In a particularly preferred embodiment, the tabs are arranged so as to provide a range of switching combinations between the two tracks, in particular the full range of logic outputs possible from two circuits, namely four binary logic states. To achieve this, the tabs from one track are arranged such that they partially overlap in the circumferential direction with tabs from the other track in some areas, and are completely circumferentially offset from each other in others. Thus, in use, the projection of the rotary actuator effects a first state in positions where tabs from both concentric track extend into the region between the arcuate portions of the tracks, a second state in positions where only a tab from the radially outer concentric track extends into said region, a third state in positions where no tabs extend into said region, and a fourth state in positions where only a tab from the radially inner concentric track extends into said region. In this way, the device can advantageously be set up to give pre-set logic outputs as the actuator is rotated.

In a useful development, the tabs can be arranged, size permitting, to output any multiple of the four binary logic states switch states within one revolution of the rotary actuator, the switch furthermore being advantageously scalable form a typical 10-15 mm diameter to a diameter of 1 m or more. In yet a further development, the conducting contact on the first surface of the other substrate layer is a single plate contact.

In an alternative embodiment, the first surface of one of the substrate layers is provided with a generally arcuate track that, in parts, radially overlaps with a further generally arcuate track provided on the first surface of the other substrate layer. Furthermore, both arcuate tracks are centred on the axis of rotation of the rotary actuator and arranged such that, as said actuator rotates, the engagement of its projection against the second surface of the deformable substrate layer causes the overlapping parts of the tracks to come into contact with each other and alter the switch state.

In a development of this alternative embodiment, the generally arcuate tracks comprise a substantially arcuate portion having a plurality of radial tabs, one track having tabs extending radially inwards therefrom and the other track having tabs extending radially outwards therefrom, whereby the tracks radially overlap via their tabs. In yet a further development, the generally arcuate tracks can be arranged to overlap each other such that, as with the prior embodiment, the device alternates between various switch states as the actuator is rotated.

In an additional alternative embodiment, the first surface of one of said substrate layers is provided with a plurality of separate contacts that are arranged in a circle, said circle being centred on the axis of rotation of the actuator member such that, as the rotary actuator rotates, the engagement of its projection against the second surface of the deformable substrate layer causes said plurality of contacts to come into contact sequentially with the conducting contact on the first surface of the other substrate layer. In this way, the device can advantageously be set up to give positional output as the actuator is rotated.

In a useful development, the rotary actuator is mounted around a constraining axis that runs substantially perpendicularly to the base. This helps ensure that the actuator engages evenly into the second surface of the deformable substrate layer. Furthermore, the rotary actuator is preferably mounted to be freely and smoothly rotatable, in either direction, through its full range of angular movement. However, detent means may be associated with the actuator, such as radial recesses in a housing part or axial recesses in the base, which operate to constrain the angular movement of the rotary actuator such that it has a plurality of distinct contact positions into which it moves as it is rotated.

The projection on the rotary actuator, which engages against the second surface of the one deformable substrate layer, may be rigid and integrally formed with the rotary actuator, but is preferably formed as a separate part, in particular comprising a ball that is received in an axial recess in the actuator and has biasing means, such as a compressive spring, associated therewith, which urges said ball out of the recess towards the substrate layers.

In an additional development, the substrate layers of the base are separated by adhesive, which is advantageously positioned between the outer radial edges of said layers, preferably joining them in a sealing fashion so that the device can be used in hazardous environments such as damp areas. In yet a further advantageous development the base has a through-hole at its centre in which an axle of the rotary actuator is mounted, with the inner radial edges of the substrate layers created by said through-hole preferably also being separated and joined in a sealing fashion with adhesive. In still a further advantageous development, the adhesive can be printed onto the substrates layers.

In a further embodiment, the switch is double-ended, a pair of substrate layers being associated with each axial end of the actuator and separate circuits associated with each end being switched by engagement of a deformable substrate layer of each pair by an axial projection provided on each end of the actuator. Such a device advantageously enables the switching of a larger number of circuits as the rotary actuator is rotated.

More than one projection could also be provided on each end of the actuator, positioned at different radial distances from the axis of rotation of the actuator, each projection being associated with a different contact or set of tracks for switching a separate circuit or set of circuits.

BRIEF DESCRIPTION OF THE DRAWINGS

In order that the invention may be well understood, there will now be described an embodiment thereof, given by way of example, reference being made to the accompanying drawing, in which.

DETAILED DESCRIPTION OF THE INVENTION

Figure 1:
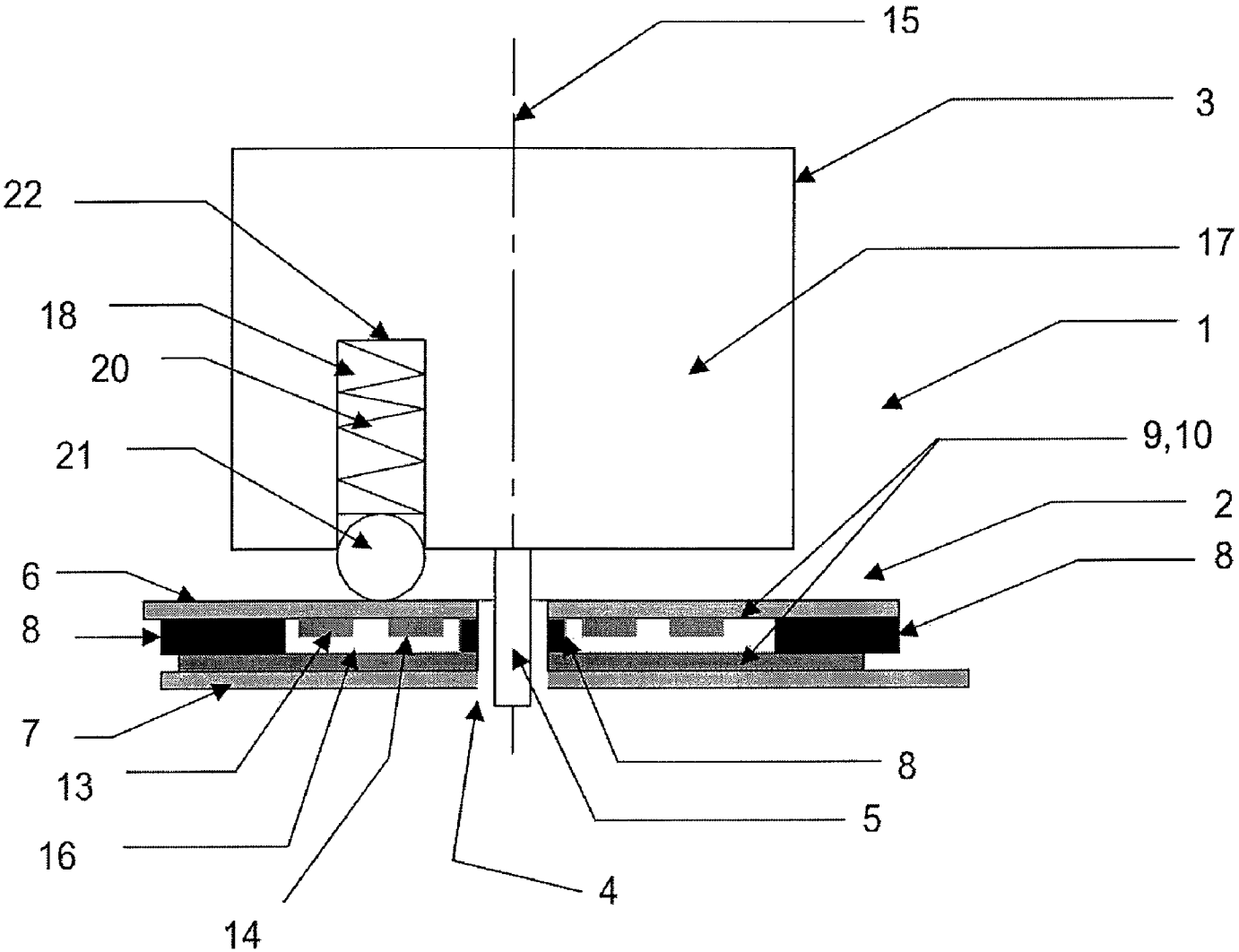
FIG. 1 is a sectional side view of a rotary electric switch according to a first embodiment of the invention.

Referring to FIG. 1, there is shown a rotary electric switch 1 comprising a base 2 and a rotary actuator 3, the base 2 having a through-hole 4 at its centre, in which an axle 5 of the rotary actuator 3 is mounted, a first substrate layer 6, and a second substrate layer 7 overlying the first substrate layer 6 so as to be parallel thereto. The two layers 6, 7 are furthermore separated apart by an adhesive 8, which joins the radially outer and inner edges of the substrate layers 6, 7 in a sealing fashion. Each of the substrate layers 6, 7 has a first surface 9, 10 which faces the other substrate layer 6, 7 and a second surface 11, 12 opposite said first surface 9, 10. The first surface 9 of the first substrate layer 6 has a pair of concentric, radially spaced, generally arcuate conducting tracks 13, 14 mounted thereon, which are centred on the axis of rotation 15 of the rotary actuator 3, and the first surface 10 of the second substrate layer 7 has a conducting plate 16 mounted thereon which overlies the conducting tracks 13, 14. The first substrate layer 6 is furthermore made of flexible material so as to be deformable towards the second layer 7 in order to bring the conducting plate 16 selectively into electrical contact with the tracks 13, 14 as described hereinafter.

Still referring to FIG. 1, the rotary actuator 3 comprises a body 17 that is rotatable around the axle 5 that defines the longitudinal axis of rotation 15, which runs through the centre of, and perpendicularly to, the base 2. An axial recess 18 is formed in the end face 19 of the body 17 that is directed towards the base 2, in which recess 18 a compressive spring 20 and a ball 21 are mounted, the compressive spring 20 engaging between the inner end 22 of the recess 18 and the ball 21 in order to urge the ball 21 out of the recess 18 towards the base 2, thereby pressing the deformable first substrate layer 6 towards the second substrate layer 7 in the immediate vicinity of the ball 21. It will, of course, be understood that the any compressive spring device may be used, such as a helical spring, elastomeric material or the like.

Figure 2:
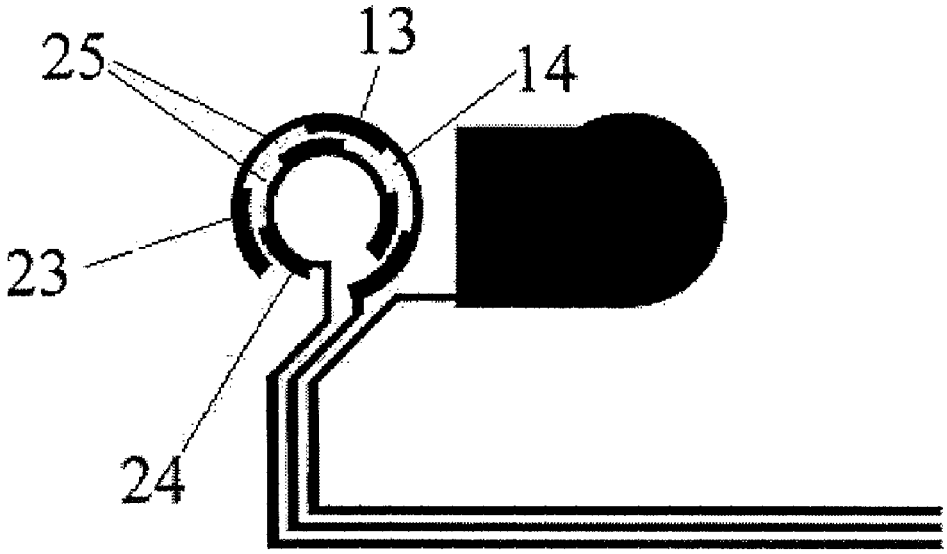
FIG. 2 is a plan view of the layout of the conducting contacts of the invention according to FIG. 1 with the conducting plate folded out through 180.degree. so as to show more clearly the conducting tracks, which would, in use, be facing opposite it.

To enable an electrical connection to be affected between the conducting plate 16 and one or other, or even both, of the conducting tracks 13, 14 depending on the radial position of the ball 21, said conducting tracks 13, 14 comprise a substantially arcuate portion 25 having a plurality of radial tabs 23, 24 extending therefrom, the tabs 23, 24 on each track 13, 14 extending towards but terminating short of the tabs 23, 24 on the other track 13, 14. Furthermore, the tabs 23 from one track 13 are arranged such that they partially overlap in the circumferential direction with tabs 24 from the other track 14 in some areas, and are completely circumferentially offset from each other in others. Thus, in use, the projected ball 21 of the rotary actuator 3 effects a first state in positions where tabs 23, 24 from both concentric track 13, 14 extend into the region between the arcuate portions 25 of the tracks 13, 14, a second state in positions where only a tab 23 from the radially outer concentric track 13 extends into said region, a third state in positions where no tabs 23, 24 extend into said region, and a fourth state in positions where only a tab 24 from the radially inner concentric track 14 extends into said region. Thus, the switch 1 is set up to give a full range of logic outputs from the two conducting tracks 13, 14, namely four binary logic states, and, as is shown in FIG. 2, is arranged to give three multiples of the four logic states per revolution.

It will be appreciated, however, that many different variations of this embodiment are possible. For example, the mounting configuration of the conducting contacts could be reversed such that the conducting tracks 13, 14 are mounted on the first surface 10 of the second substrate layer 7 and the conducting plate 16 is mounted on the first surface 9 of the first substrate layer 6, the compressive spring 20 could be replaced by other suitable biasing means such as a block of resiliently deformable material, the projection of the rotary actuator that engages against the second surface of the first substrate layer could be rigid and integrally formed with the rotary actuator as opposed to being separately formed and taking the form of a ball 21 and biasing means, the conducting tracks 13, 14 could be arranged to give any multiple of the four switching states, size permitting, and the conducting contacts mounted on the first surfaces 9, 10 of the substrate layers 6, 7 could take any form and be arranged in any manner so as to provide any desired switching output.

Furthermore, it will additionally be appreciated that detent means could be associated with the actuator 3 which constrain said actuator into a plurality of set rotation positions. In particular, the detent means could have radially extending, resiliently deformable teeth on an outer circumferential edge which engage in complementary shaped serrations formed on an inner annular surface of the base, the teeth being deformable upon rotation of the actuator to enable ratcheted movement of the actuator as the teeth move around the serrations. Alternatively, however, axially extending teeth could be provided which engage in axially extending serrations arranged in an annular path on the face of the base.

Figure 3:
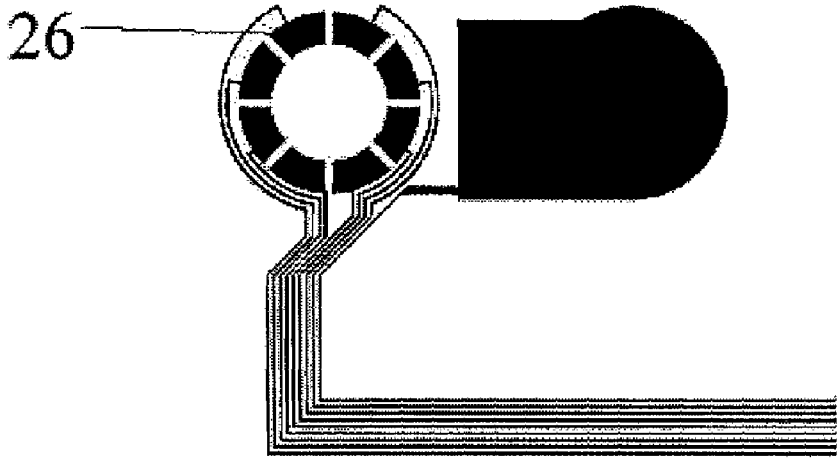
FIG. 3 is a plan view of the layout of the conducting contacts of a further embodiment of the invention with the conducting plate folded out through 180.degree. so as to show more clearly the contacts that would, in use, be facing opposite it.

Referring to FIG. 3, the electric switch can alternatively be set up to give a positional output. In this embodiment, the switch is identical to the first embodiment except that the first surface of the first substrate layer is provided with a plurality of separate contacts 26 mounted thereon. These contacts 26 are arranged in a circle, said circle being centred on the axis of rotation of the rotary actuator such that, as the said actuator rotates, its engagement into the deformable first substrate layer causes said plurality of contacts 26 to come into contact sequentially with the conducting plate 16 on the first surface of the second substrate layer.

Furthermore, in a development not shown, the rotary electric switch is identical to the first embodiment except that it is double-ended, a pair of substrate layers being associated with each axial end of the actuator and separate circuits associated with each end being switched by engagement of a deformable substrate layer of each pair by a projected ball provided on each end of the actuator. In this way, the rotary electric switch can switch a larger number of circuits as the body is rotated.

In yet a further development not shown, more than one projected ball is provided on each end of the actuator, positioned at different radial distances from the axis of rotation of the actuator, each projection being associated with a different contact or set of tracks for switching a separate circuit or set of circuits.

The invention claimed is:

1. A rotary electric switch comprising a base having a rotary actuator mounted thereon, the base including a pair of substantially parallel, spaced apart substrate layers, each said layer having a first surface which faces the other substrate layer and a second surface which faces away from the other substrate layer, the first surface of each layer having an electrically conducting contact provided thereon, spacing means being provided to maintain the contacts spaced apart and hence electrically isolated from each other, and at least one of said substrate layers being deformable towards said other substrate layer so as to effect an electrical connection between said contacts on the two layers, and the rotary actuator including a projection which engages against the second surface of said deformable substrate layer so as to press it towards the other layer in the immediate vicinity of the projection, whereby rotation of the rotary actuator moves the projection relative to the substrates and hence varies the point of electrical connection between the contacts, first surface of one of said substrate layers having a pair of contacts in the form of concentric, radially spaced substantially arcuate tracks which are centered on the axis of rotation of the rotary actuator, each of said pair of tracks comprising a substantially arcuate portion having a plurality of radial tabs extending therefrom, the tabs on each track extending towards but terminating short of the tabs on the other track of the pair, the projection of the rotary actuator being positioned so as to press the deformable substrate towards the other substrate in the region between the arcuate portions so that the electrical connections are effected by the tabs.

2. A rotary electric switch according to claim 1, wherein upon deformation of the deformable substrate layer the contact on the first surface of the other of said substrate layers contacts both tracks of the pair of tracks of the one substrate layer so as to effect a short therebetween.

3. A rotary electric switch according to claim 1, wherein the first surface of the other of said substrate layers has a pair of contacts, each of which, upon deformation of the deformable substrate layer, contacts one of the pair of tracks of the one substrate layer so as to effect a short between each contact and its associated track.

4. A rotary electric switch according to claim 1, wherein the tabs of one track of the pair on the one substrate layer are arranged such that they partially overlap in the circumferential direction with tabs from the other track of the same layer in some areas, but are completely circumferentially offset from each other in others, whereby the projection of the rotary actuator effects a first switch state in positions where tabs from both concentric track extend into the region between the arcuate portions of the tracks, a second state in positions where only a tab from the one of the tracks extends into said region, a third state in positions where no tabs extend into said region, and a fourth state in positions where only a tab from the other of the tracks extends into said region so that a pre-set logic output is produced as the actuator is rotated.

5. A rotary electric switch according to claim 1, therein the conducting contact on the first surface of the other substrate layer is a single plate contact.

6. A rotary electric switch according to claim 1, wherein the contacts on the first and second surfaces are concentric tracks centered on the axis of rotation of the rotary actuator, which tracks radially overlap with each other at some points along their length, whereby as said actuator rotates, the engagement of its projection against the second surface of the deformable substrate layer causes the overlapping parts of the tracks to come into contact with each other and alter the switch state.

7. A rotary electric switch according to claim 6, wherein each concentric track comprises a substantially arcuate portion having a plurality of radial tabs, one track having tabs extending radially inwards therefrom and the other track having tabs extending radially outwards therefrom which overlap said inwardly extending tracks.

8. A rotary electric switch according to claim 1, wherein the first surface of one of said substrate layers is provided with a plurality of separate contacts that are arranged in a circle, said circle being centred on the axis of rotation of the actuator member such that, as the rotary actuator rotates, the engagement of its projection against the second surface of the deformable substrate layer causes said plurality of contacts to come into contact sequentially with the conducting contact on the first surface of the other substrate layer.

9. A rotary electric switch according to claim 1, wherein detent means are associated with the actuator which operate to constrain the angular movement of the rotary actuator such that it has a plurality of distinct contact positions between which it moves as it is rotated.

10. The rotary electric switch according to claim 9, wherein the detent means comprises radial recesses in the housing part.

11. The rotary electric switch according to claim 9, wherein the detent means comprises axial recesses in the base.

12. A rotary electric switch according to claim 1, wherein the projection of the rotary actuator comprising a ball that is received in an axial recess in the actuator and has biasing means associated with it which urges said ball out of the recess towards the substrate layers.

13. A rotary electric switch according to claim 1, wherein the substrate layers of the base fixed together by adhesive means so as to seal the contacts therein, isolating them from the surrounding environment, said adhesive means acting as said spacing means which maintains the contacts normally spaced apart from each other.

14. A rotary electric switch according to claim 1, wherein the switch is double-ended, a pair of substrate layers being associated with each axial end of the actuator and separate circuits associated with each end being switched by engagement of a deformable substrate layer of each pair by an axial projection provided on each end of the actuator.

* * * * *